United States Patent [19]

Ott

[11] Patent Number: 5,021,017

[45] Date of Patent: Jun. 4, 1991

[54] WATER SPORTS BOARD WITH ADJUSTABLE BINDER PLATES

[75] Inventor: Arthur Ott, Greensboro, Ga.

[73] Assignee: Wellington Leisure Products, Inc., Madison, Ga.

[21] Appl. No.: 575,385

[22] Filed: Aug. 30, 1990

[51] Int. Cl.[5] ..... B63B 35/85

[52] U.S. Cl. ..... 441/70; 280/617

[58] Field of Search ..... 114/39.2; 441/65, 68, 441/70, 74, 75; 280/617, 618

[56] References Cited

U.S. PATENT DOCUMENTS

| | | | |
|---|---|---|---|
| 2,740,972 | 4/1956 | Taylor | 9/21 |
| 2,933,741 | 4/1960 | Walter | 9/310 |
| 3,102,279 | 9/1963 | Bennelt | 9/310 |
| 3,127,623 | 4/1964 | Roudebush | 9/310 |
| 4,604,070 | 8/1986 | McKee et al. | 441/70 |
| 4,718,873 | 1/1988 | Shaw et al. | 441/70 |
| 4,871,337 | 10/1989 | Harris | 441/70 |

FOREIGN PATENT DOCUMENTS

| | | | |
|---|---|---|---|
| 2593135 | 7/1987 | France | 441/70 |

OTHER PUBLICATIONS

Catalog Sheet-Surf Ski TM S4926 (36763).

*Primary Examiner*—Ed Swinehart
*Attorney, Agent, or Firm*—Kennedy & Kennedy

[57] ABSTRACT

A water sports board (10) has a base (11) formed with rows of detent teeth (16) for locking engagement with the peripheral teeth (26) of binder plates (22), so that the binder plate may be angularly or longitudinally adjusted relative to the base. The board also has a pair of boots (21, 23) that are mounted to the binder plates and mounting assemblies for mounting the binder plates to the base.

13 Claims, 1 Drawing Sheet

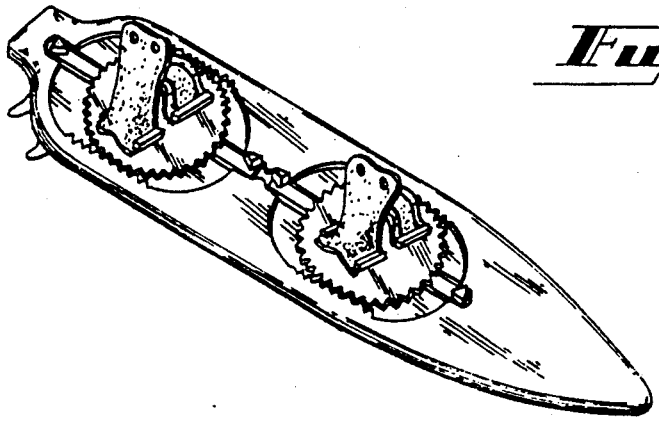
Fig 1
Fig 2
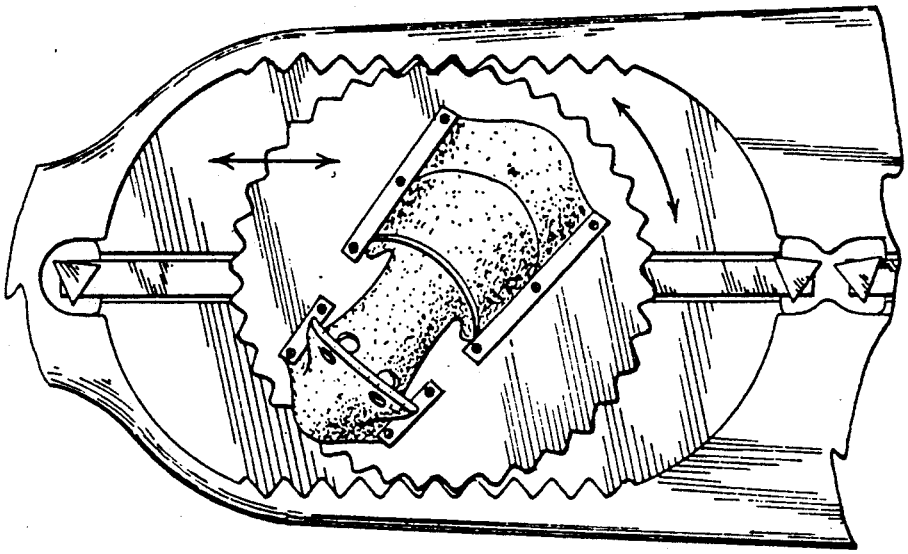
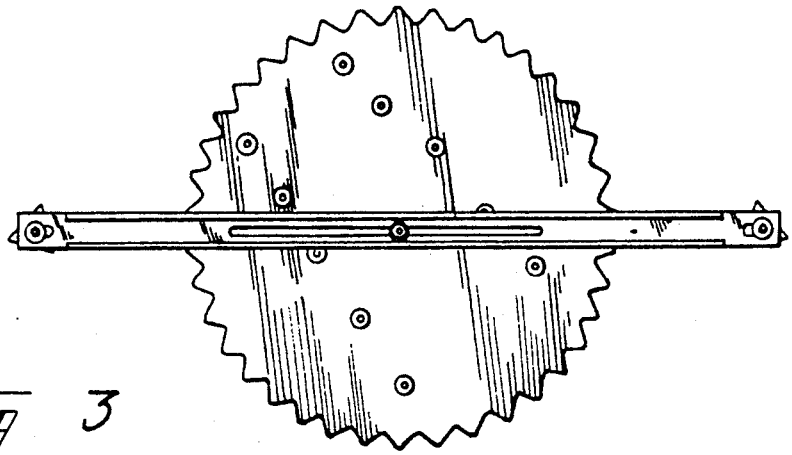
Fig 3

WATER SPORTS BOARD WITH ADJUSTABLE BINDER PLATES

TECHNICAL FIELD

This invention relates to water sports board of the type upon which a rider stands with his feet held in place by bindings and is towed behind a power boat.

BACKGROUND OF THE INVENTION

Today there exits several kinds of water sports boards including surfboards, kneeboards, water skis and boards upon which a rider, towed by a power boat, stands with his feet spread longitudinally apart upon the board. Some of these boards, including the last mentioned type to which this invention particularly pertains, are equipped with foot bindings to stabilize the rider upon the board and to enhance his foot control of the board.

With this latter type of board, which has only recently obtained popularity, the rider positions his feet on the board one behind the other at a skewed angle with respect to the longitudinal axis of the board.

This posture thus is similar to that used by surfers on surfboards. Initially these types of boards were merely equipped with strips of course, frictional material to provide foot traction. Since they were pulled in tow behind powerful motor boats riders quickly found that they were not able to maintain their feet in position well enough when subjected to strong tow rope pulling forces. Thus today these types of water sports boards are also equipped with foot bindings.

Water ski foot bindings are typically comprised of a toe piece and a heal piece mounted to the top surface of the ski. One of the pieces is usually adjustable to accommodate different skier foot sizes and to facilitate foot entry. Exemplary of these are those shown in U.S. Pat. Nos. 2,933,741, 3,102,279 and 3,127,623. Water ski bindings have also existed by which the position of the whole binding for one foot may be repositioned upon the ski. Exemplary of this type of binding is that shown in U.S. Pat. No. 2,740,972. These water ski bindings however do not provide for angular foot adjustment since water skiing is best done with the skier's feet aligned with the skis.

Recently, a board known as a Skurfer has been equipped with bindings that can be adjusted both longitudinally and angularly. Its bindings include oblong plates upon which toe and heal pieces, hereinafter collectively referred to as "boots", are mounted. The plates are held in position by threaded posts that extend through arcuate slots in the plates. Knobs are rotatably mounted on the ends of the posts for holding the plates firmly in place at selected positions upon the board. Though these types of bindings have permitted both longitudinal and angular positioning, they have tended to loosen and skew in operation. Also, their degree of angular adjustment has been limited.

It thus is seen that a water sports board of the type having foot bindings which can be more fully adjusted rotationally, as well as longitudinally adjusted, and which may be easily yet securely repositioned, has remained an elusive goal. Accordingly, it is to the provision of such a board that the present invention is primarily directed.

SUMMARY OF THE INVENTION

In a preferred form of the invention a water sports board comprises an elongated base having a longitudinal axis that longitudinally bisects the base and detent means on each side of the axis. The board has at least one generally disk-shaped binder plate having of radially projecting peripheral teeth on which a boot is mounted. The board further comprises means for mounting the disk-shaped binder plate to the base in multiple angular positions with respect thereto with the detent means in engagement with the binder plate peripheral teeth.

In another preferred form of the invention, a water sports board comprises an elongated base having a longitudinal axis and an upper surface that bears two rows of base teeth that straddle the axis. The board has a pair of boots mounted to the base one behind the other along the axis by mounting means that comprises binder plates to which the boots are mounted. The binder plates have peripheral teeth extending arcuately about portions of the binder plate for mounting engagement with the base teeth in multiple angular and longitudinal positions with respect to the upper surface.

DESCRIPTION OF THE DRAWINGS

FIG. 1 is a perspective view of a water sports board embodying principles of the present invention in a preferred form.

FIG. 2 is a top view of a portion of the water sports board shown in FIG. 1.

FIG. 3 is a bottom view a portion of the board shown in FIGS. 1 and 2.

DETAILED DESCRIPTION

With reference next to the drawing there is shown a water sports board 10 of the type on which a rider, towed by a power boat, may stand with his feet spread longitudinally apart upon the board. The board 10 has an elongated base 11 that has a longitudinal axis A which herein is intended to include the longitudinally extending, vertical plane of bilateral symmetry. The upper surface 12 of the base has a rear recess 13 and a forward recess 14 that are partially defined by recess side walls 15. Each recess has detent means in the form of two rows of detent teeth 16 that extend between the recess side walls 15. Each of the recesses has a generally flat floor 17 that is bisected by an elongated trough 18 that extends along the longitudinal axis A.

Water sports board 10 also has a rear boot 21 and a forward boot 23. As the forward and rear foot binders, including boots 21 and 23 and their associated mounting means are the same, only one will now be described in detail.

The boot, which is conventually formed of a toe and heal piece, is mounted to a disk-shaped binder plate 22 that has radially projecting teeth 26 extending circumferentially about the plate periphery for locking engagement with the two rows of teeth 16. The binder plate 22 is mounted directly to an elongated mounting bar 27 by extending a bolt 28 through a hole in the center of the binder plate and through an elongated slot 29 in the bar 27. A sliding washer and lock washer are mounted on the bolt and a nut 31 secured to it to hold the binder plate 22 slidably mounted to the mounting bar 27. The mounting bar 27 also has a slot 33 in each end through which a threaded post extends into a threaded hole in the base 11. A knob 32 is screwed onto the post up against the bar thereby holding the bar firmly to the base.

In use, a rider may position the boots 21 and 23 to a desired longitudinal and angular position relative to the base so as to accommodate his or her stride, which is a function of his height, and to accommodate his desired angle of attack, i.e. the degree of skew of his feet. This is accomplished by simply loosening the knobs 32 sufficiently to allow the binder plate teeth 26 to become disengage from and elevated above the base rows of teeth 16. The binder plate 22 can then be slid along the elongated mounting bar 27 and rotated to the desired angular position. The plate is then lowered so as to mesh the teeth 16 with the teeth 26. Knobs 32 are then tightened thereby locking the binder plate and boot securely in place upon the base.

The just described structure has been found to eliminate problems associated with previous boards. As a rider skies rotational forces exerted on the binder plate are applied to the faces of several teeth in abutment rather than to a rotatable type of fastener. This security enables the skier to ski with confidence that the binder will not loosen which confidence tends to improve his or her performance. As the teeth of the binder plate extend all about the plate periphery, it may be mounted virtually omnidirectionally with respect to the board.

The board recesses allows the upper surface of the base rows of teeth to be flush with the base upper surface itself. This enhances safety by reducing the number of projections extending from the upper surface which can harm skiers during falls. In this regard note also that knobs 32 are also located within recesses that communicate with recesses 13 and 14. To most the configuration of the teeth and upper surface is also more aesthetically pleasing than row of teeth projecting upwardly from the base. The recess troughs allow the binder plates to be mounted flush upon the recess floors thereby preventing the disk-shaped binder plates from tilting significantly.

From the foregoing it is seen that a water sports board is now provided which overcomes problems associated with those of the prior art. It should however be understood that the just described embodiment merely illustrates principles of the invention in a preferred form. Many modifications, additions and deletions may, of course, be made thereto without departure from the spirit and scope of the invention as set forth in the following claims.

I claim:

1. A water sports board comprising an elongated base having a longitudinal axis that longitudinally bisects the base and detent means on each side of said axis, at least one generally disk-shaped binder plate having a plurality of radially projecting peripheral teeth, a boot mounted to said binder plate, and means for mounting said disk-shaped binder plate to said base in a plurality of angular positions with respect thereto with said detent means in engagement with said peripheral teeth.

2. A water sports board as claimed in claim 1 wherein said detent means comprises two rows of teeth in which at least two of said binder plate peripheral teeth are in mesh.

3. A water sports board as claimed in claim 1 wherein said binder plate peripheral teeth extend circumferentially continuously about said binder plate periphery for multi-directional angular mounting of said binder plate upon said elongated base.

4. A water sports board as claimed in claim 1 wherein said elongated base has an upper surface formed with a recess defined by recess side walls, and wherein said detent means comprises teeth formed in said recess side walls.

5. A water sports board as claimed in claim 4 wherein said plate mounting means comprises an elongated bar to which said binder plate is pivotally mounted and fastening means for releasable fastening said bar to said elongated base.

6. A water sports board as claimed in claim 5 wherein said mounting means bar has an elongated slot, and wherein said mounting means further comprises a bolt extending through said bar slot and secured to said binder plate and said base for slidably positioning said binder plate longitudinally along said mounting means bar.

7. A water sports board as claimed in claim 5 wherein said recess has a generally flat floor in which a trough extends along said base longitudinal axis, and wherein said mounting means bar is releasable fastened to said base within said trough.

8. A water sports board comprising an elongated base having a longitudinal axis and an upper surface bearing two rows of base teeth that straddle said axis, a pair of boots mounted to said base one behind the other along said axis by mounting means that comprises at least one binder plate to which one of said boots is mounted, and wherein said binder plate has peripheral teeth extending arcuately about at least portions of said binder plate for mounting engagement with said base teeth in a plurality of angular and longitudinal positions with respect to said upper surface.

9. A water sports board as claimed in claim 8 wherein said upper surface further comprises a second recess defined by recess side walls that include two other rows of base teeth, and wherein said mounting means comprises a second binder plate to which the other of said boots is mounted, said second binder plate having peripheral teeth extending arcuately about at least portions of said second binder plate for mounting engagement with said base teeth of said other rows of teeth in a plurality of angular and longitudinal positions with respect to said upper surface and to said one binder plate and said one boot.

10. A water sports board as claimed in claim 8 wherein said upper surface is formed with a recess defined by recess side walls that include said two rows of base teeth.

11. A water sports board as claimed in claim 10 wherein said mounting means further comprises an elongated bar to which said binder plate is pivotally mounted and fastening means for releasable fastening said bar to said elongated base.

12. A water sports board as claimed in claim 11 wherein said mounting means bar has an elongated slot, and wherein said mounting means further comprises a bolt extending through said slot and secured to said binder plate and said base for slidably mounting said binder plate to said mounting means bar in a plurality of positions along said axis.

13. A water sports board as claimed in claim 11 wherein said recess has a generally flat floor in which a trough extends along said base axis, and wherein said mounting means bar is releasable fastened to said base within said trough.

* * * * *